US007614187B1

(12) United States Patent
Forbes

(10) Patent No.: US 7,614,187 B1
(45) Date of Patent: Nov. 10, 2009

(54) HURRICANE PROTECTION SYSTEM

(76) Inventor: Scott J. Forbes, 9149 N. Cacalia Dr., Crystal River, FL (US) 34428

( * ) Notice: Subject to any disclaimer, the term of this patent is extended or adjusted under 35 U.S.C. 154(b) by 296 days.

(21) Appl. No.: 11/809,381

(22) Filed: Jun. 1, 2007

(51) Int. Cl.
*E05D 15/22* (2006.01)

(52) U.S. Cl. ..... 52/202; 52/127.2; 49/57; 49/61; 49/465; 410/145; 410/151

(58) Field of Classification Search ..... 49/50, 49/56, 57, 61, 62, 63, 463, 464, 465; 52/106, 52/127.2, 202, 203, 204.61, 741.3, 833; 248/200.1, 248/188.5; 410/144, 145, 151
See application file for complete search history.

(56) References Cited

U.S. PATENT DOCUMENTS 1,023,650 A * 4/1912 Hovagimian ..... 211/105.6
4,025,004 A 5/1977 Massey
4,705,258 A * 11/1987 Frei ..... 249/27
4,779,910 A * 10/1988 Dameron ..... 292/259 R
5,335,452 A 8/1994 Taylor
5,709,054 A * 1/1998 McGillivray ..... 52/167.1
6,330,768 B1 12/2001 Rodriguez
6,363,670 B1 4/2002 Dewitt
7,243,467 B2 * 7/2007 Peccoraro ..... 52/202
7,526,896 B1 * 5/2009 Lohmeyer et al. ..... 52/202
2003/0067176 A1 * 4/2003 Stevens et al. ..... 292/339

* cited by examiner

*Primary Examiner*—George Nguyen
*Assistant Examiner*—Theodore Adamos

(57) ABSTRACT

A bar assembly includes hollow interior and exterior tubes. Each tube has an inner and an outer end. The tubes are of a length less than the distance between spaced vertical window jamb side surfaces. The bar assembly includes a rigid stopper. A stopper is press fit into the outer end of each tube. The bar assembly includes pins. A pin extends outwardly from each stopper. The bar assembly includes a coil spring. The coil spring is provided within the exterior tube. The coil spring has a first end. The first end is in contact with the stopper of the exterior tube. The coil spring has a second end. The second end is in contact with the inner end of the interior tube. The coil spring is adapted to be compressed to a loading orientation. The coil spring is further adapted to be expanded to an operational orientation.

3 Claims, 4 Drawing Sheets

FIG 1
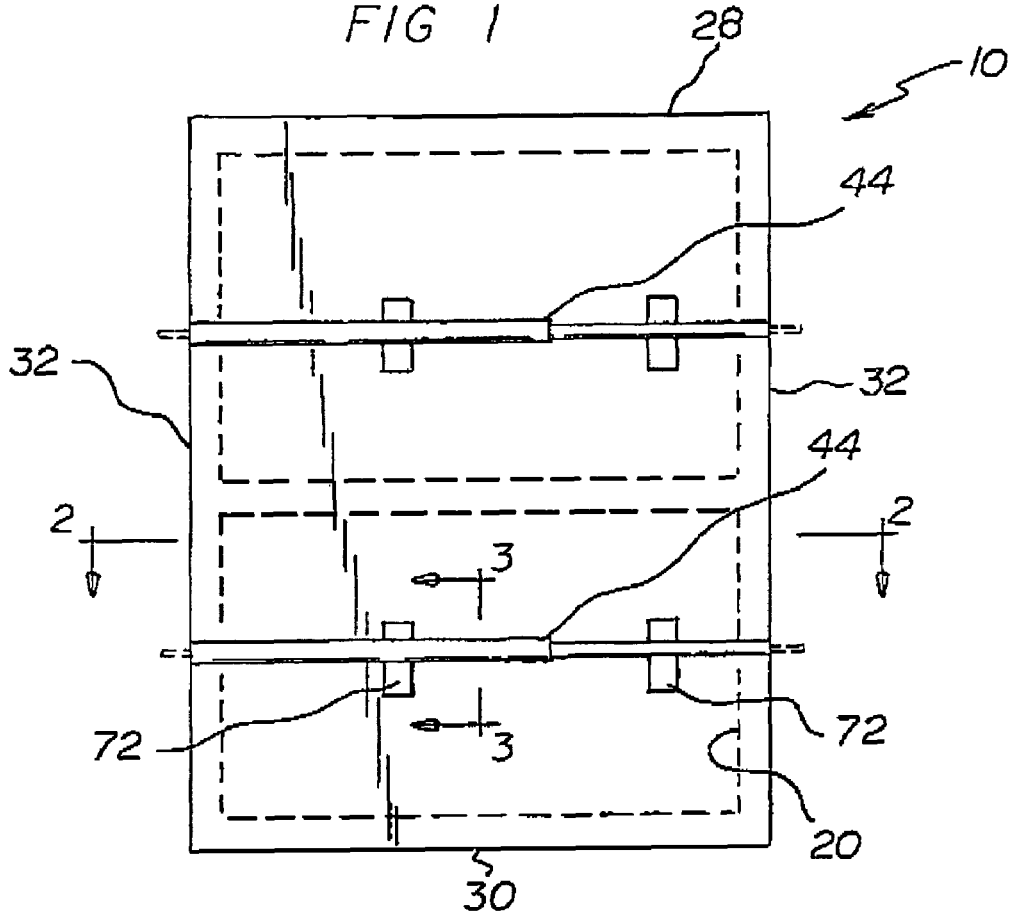
FIG 2
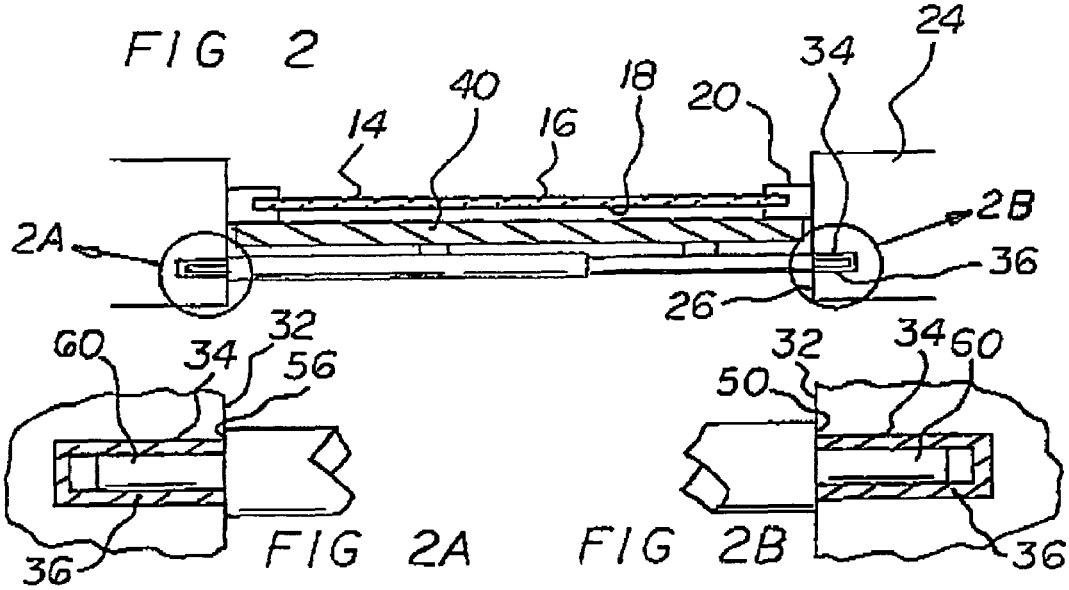
FIG 2A FIG 2B

FIG 3
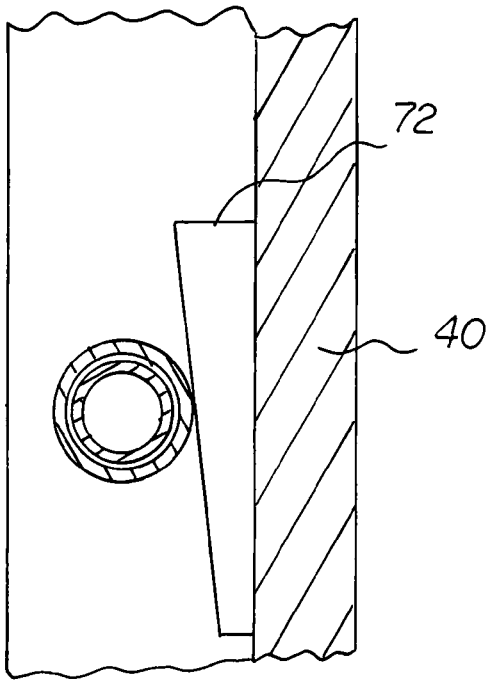
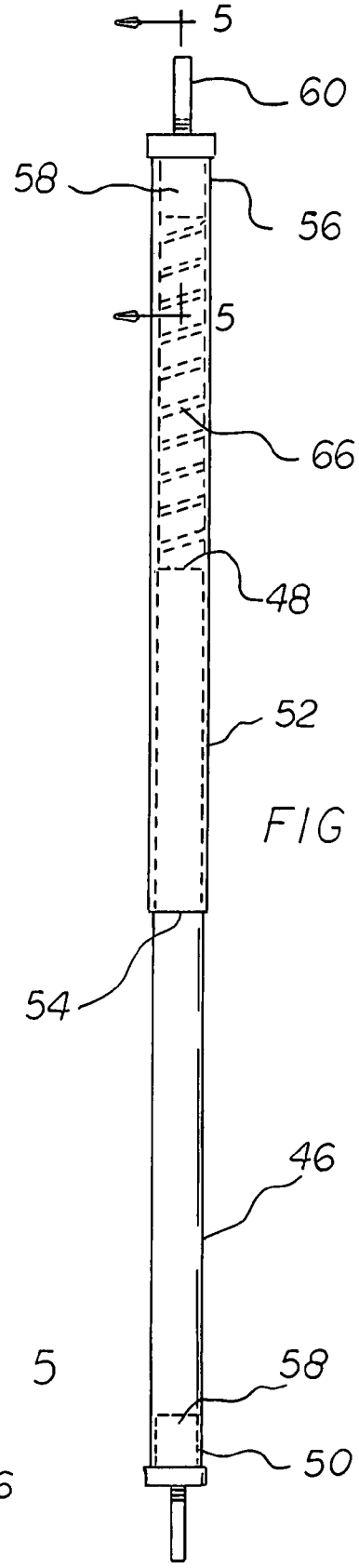
FIG 4
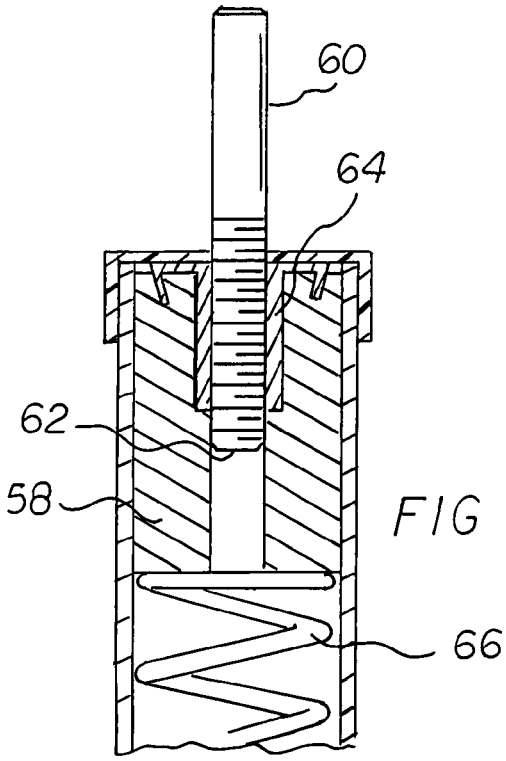
FIG 5

FIG 6
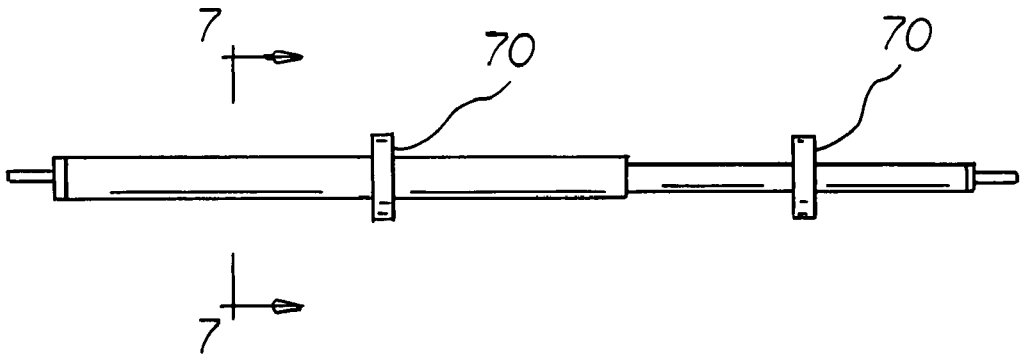
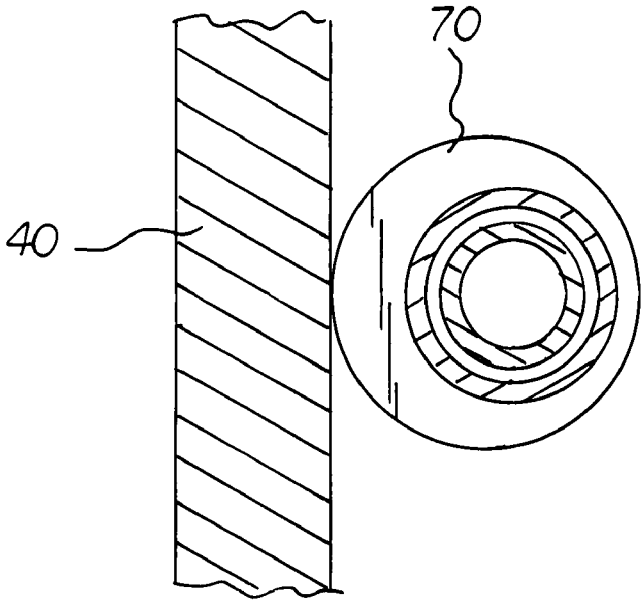
FIG 7

FIG 8
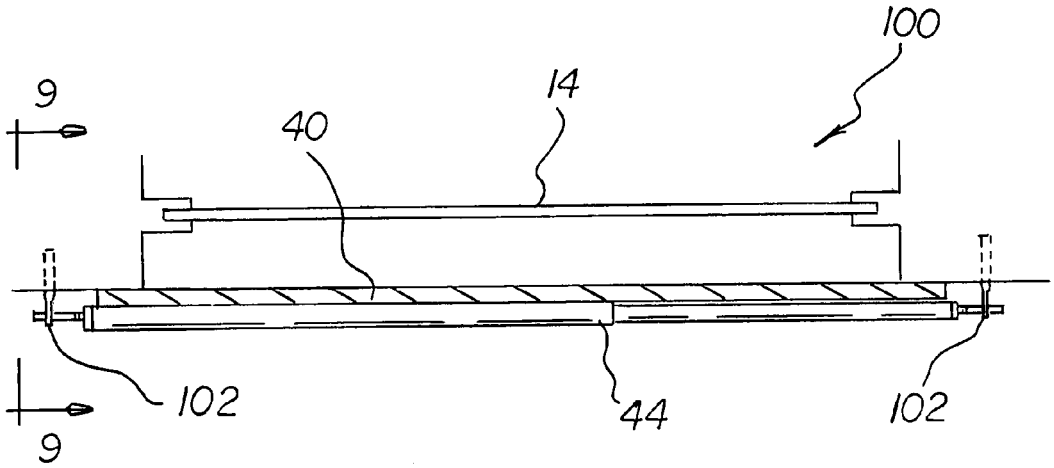
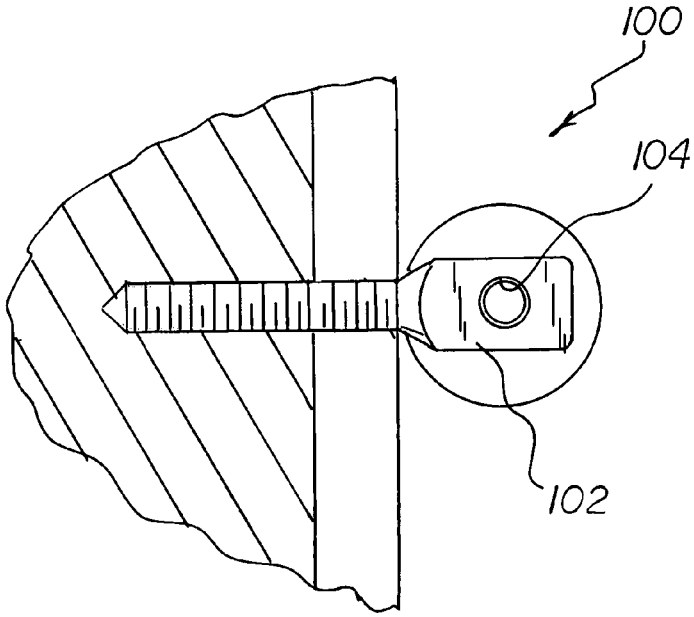
FIG 9

HURRICANE PROTECTION SYSTEM

BACKGROUND OF THE INVENTION

1. Field of the Invention

The present invention relates to a hurricane protection system and more particularly pertains to precluding damage to windows during hurricanes in an efficient and economical manner.

2. Description of the Prior Art

The use of storm protection systems of known designs and configurations is known in the prior art. More specifically, storm protection systems of known designs and configurations previously devised and utilized for the purpose of protecting windows through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,025,004 issued May 24, 1977 to Massey relates to a Toilet Tissue Roll Holder. U.S. Pat. No. 5,335,452 issued Aug. 9, 1994 to Taylor relates to a Hurricane Panel Apparatus. U.S. Pat. No. 6,330,768 issued Dec. 18, 2001 to Rodriguez relates to a Window Storm Panel Brace. Lastly, U.S. Pat. No. 6,363,670 issued Apr. 2, 2002 to Dewitt relates to a Hurricane Protection System.

While these devices fulfill their respective, particular objectives and requirements, the aforementioned patents do not describe a hurricane protection system that allows for precluding damage to windows during hurricanes in an efficient and economical manner.

In this respect, the hurricane protection system according to the present invention substantially departs from the conventional concepts and designs of the prior art, and in doing so provides an apparatus primarily developed for the purpose of precluding damage to windows during hurricanes in an efficient and economical manner.

Therefore, it can be appreciated that there exists a continuing need for a new and improved hurricane protection system which can be used for precluding damage to windows during hurricanes in an efficient and economical manner. In this regard, the present invention substantially fulfills this need.

SUMMARY OF THE INVENTION

In view of the foregoing disadvantages inherent in the known types of storm protection systems of known designs and configurations now present in the prior art, the present invention provides an improved hurricane protection system. As such, the general purpose of the present invention, which will be described subsequently in greater detail, is to provide a new and improved hurricane protection system and method which has all the advantages of the prior art and none of the disadvantages.

To attain this, the present invention essentially comprises a hurricane protection system. First provided is a rectangular window. The window is oriented in an essentially vertical plane. The window has an inside. The window has an outside. A peripheral support is provided. The peripheral support retains the window.

A wall is provided. The wall is in an essentially vertical plane. The wall has a rectangular opening. The rectangular opening is defined by a horizontal header surface. The horizontal header surface is provided above the rectangular opening. The rectangular opening is further defined by a horizontal sill surface. The horizontal sill surface is provided below the rectangular opening. Spaced vertical jamb side surfaces are provided between the header and sill surfaces. The spaced vertical jamb side surfaces are spaced by a fixed distance. The surfaces fixedly support the peripheral support with the window there within. The jamb side surfaces each have pairs of cylindrical holes. The holes of each pair are in axial alignment. The holes are spaced from the header surface and the sill surface. A plastic sleeve is provided. The plastic sleeve has a length. In this manner the plastic sleeve may be received within each hole.

Provided next is a ridged wooden panel. The wooden panel is in a rectangular configuration. The wooden panel is positioned within the opening in contact with the peripheral support during operation and use. The wooden panel has upper, lower and side surfaces. An upper edge of the wooden panel is adjacent to the header surface. A lower edge of the wooden panel adjacent to the sill surface. Parallel side edges are adjacent to the jamb side surfaces.

A bar assembly is provided next. The bar assembly includes a hollow interior tube. The interior tube has an inner end. The interior tube has an outer end. The bar assembly also includes a hollow exterior tube. The exterior tube has an inner end. The exterior tube has an outer end. The tubes are each of a length less than the distance between the spaced vertical jamb side surfaces. The bar assembly includes a rigid stopper. The stopper has an axial aperture and is press fit into the outer end of each tube. The bar assembly has a pin. The pin extends outwardly from each stopper. Each pin includes a base and a Tee-nut received within an axial aperture. Each base is threadedly received within a Tee-nut. The pins are of a length less than the length of the sleeves. A coil spring is provided. The coil spring is provided in the exterior tube. The coil spring has a first end. The first end is in contact with the stopper of the exterior tube. The second end is in contact with the inner end of the interior tube. The coil spring is adapted to be compressed to a loading orientation. In this manner the pins are located between the sleeves and an expanded operational orientation with the pins within the sleeves and the tubes in proximity to the panel.

Provided last is a pair of wedges. The wedges are provided on the panel facing the bar assembly. In this manner the contact force imparted by the bar assembly on the panel is maximized.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hurricane protection system which has all of the advantages of the prior art storm protection systems of known designs and configurations and none of the disadvantages.

It is another object of the present invention to provide a new and improved hurricane protection system which may be easily and efficiently manufactured and marketed.

It is further object of the present invention to provide a new and improved hurricane protection system which is of durable and reliable constructions.

An even further object of the present invention is to provide a new and improved hurricane protection system which is susceptible of a low cost of manufacture with regard to both materials and labor, and which accordingly is then susceptible of low prices of sale to the consuming public, thereby making such hurricane protection system economically available to the buying public.

Even still another object of the present invention is to provide a hurricane protection system for precluding damage to windows during hurricanes in an efficient and economical manner.

Lastly, it is an object of the present invention to provide a new and improved hurricane protection system. A bar assembly includes hollow interior and exterior tubes. Each tube has an inner and an outer end. The tubes are each of a length less than the distance between spaced vertical window jamb side surfaces. The bar assembly includes rigid stoppers. A stopper is press fit into the outer end of each tube. The bar assembly includes pins. A pin extends outwardly from each stopper. The bar assembly includes a coil spring. The coil spring is provided within the exterior tube. The coil spring has a first end. The first end is in contact with the stopper of the exterior tube. The coil spring has a second end. The second end is in contact with the inner end of the interior tube. The coil spring is adapted to be compressed to a loading orientation. The coil spring is further adapted to be expanded to an operational orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a hurricane protection system constructed in accordance with the principles of the present invention.

FIG. 2 is a cross sectional view of the system taken along line 2-2 of FIG. 1.

FIG. 3 is a cross sectional view taken along line 3-3 of FIG. 1.

FIG. 4 is a plan view of the bar assembly shown in FIGS. 1, 2 and 3.

FIG. 5 is a cross sectional view taken along line 5-5 of FIG. 4.

FIG. 6 is a plan view of a bar assembly illustrating an alternate embodiment of the invention.

FIG. 7 is a cross sectional view taken along line 7-7 of FIG. 6.

FIG. 8 is a plan view of a system illustrating an alternate embodiment of the invention.

FIG. 9 is a cross sectional view taken along line 9-9 of FIG. 8.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved hurricane protection system embodying the principles and concepts of the present invention and generally designated by the reference numeral 10 will be described.

The present invention, the hurricane protection system 10 as described herein, has as the central component of its system a bar assembly.

First provided is a rectangular window 14. The window is oriented in an essentially vertical plane. The window has an inside 16. The window has an outside 18. A peripheral support 20 is provided. The peripheral support retains the window.

A wall 24 is provided. The wall is in an essentially vertical plane. The wall has a rectangular opening 26. The rectangular opening is defined by a horizontal header surface 28. The horizontal header surface is provided above the rectangular opening. The rectangular opening is further defined by a horizontal sill surface 30. The horizontal sill surface is provided below the rectangular opening. Spaced vertical jamb side surfaces 32 are provided between the header and sill surfaces. The spaced vertical jamb side surfaces are spaced by a fixed distance. The surfaces fixedly support the peripheral support with the window there within. The jamb side surfaces each have pairs of cylindrical holes 34. The holes of each pair are in axial alignment. The holes are spaced from the header surface and the sill surface. A plastic sleeve 36 is provided. The plastic sleeve has a length. In this manner the plastic sleeve may be received within each hole.

Provided next is a ridged panel 40. The panel is in a rectangular configuration preferably fabricated of wood. Other materials such as metal or plastic could readily be utilized. The wooden panel is positioned within the opening in contact with the peripheral support during operation and use. The wooden panel has upper, lower and side surfaces. An upper edge of the wooden panel is adjacent to the header surface. A lower edge of the wooden panel adjacent to the sill surface. Parallel side edges are adjacent to the jamb side surfaces.

A bar assembly 44 is provided next. The bar assembly includes a hollow interior tube 46. The interior tube has an inner end 48. The interior tube has an outer end 50. The bar assembly also includes a hollow exterior tube 52. The exterior tube has an inner end 54. The exterior tube has an outer end 56. The tubes are each of a length less than the distance between the spaced vertical jamb side surfaces. The bar assembly includes rigid stoppers 58. Each stopper, preferably fabricated of a dense hard wood, has an axial aperture and is press fit into the outer end of a tube. The bar assembly has pins 60. A pin extends outwardly from each stopper. Each pin includes a base 62 and a Tee-nut 64 received within an axial aperture. Each base is threadedly received within a Tee-nut.

The pins are of a length less than the length of the sleeves. A coil spring 66 is provided. The coil spring is provided in the exterior tube. The coil spring has a first end. The first end is in contact with the stopper of the exterior tube. The second end is in contact with the inner end of the interior tube. The coil spring is adapted to be compressed to a loading orientation. In this manner the pins are located between the sleeves and an expanded operational orientation with the pins within the sleeves and the tubes in proximity to the panel.

Lastly provided in the primary embodiment is a pair of shims or wedges 72. The wedges are provided on the panel facing the bar assembly. In this manner the contact force imparted by the bar assembly on the panel is maximized.

FIG. 1 illustrates a pair of horizontal bar assemblies for one window. It should be understood that one or a plurality of bar assemblies are adapted to be employed on one window as a function of the size of the window. For most applications, the bar assemblies are most efficient when placed apart two feet or less from an adjacent bar assembly or the adjacent header and sill and side surfaces. Further, the bar assemblies are adapted to be positioned vertically for horizontally oriented windows.

Provided in an alternate embodiment of the invention are a pair of eccentric lobes 70. Note FIGS. 6 and 7. The lobes are substitutes for the wedges of the primary embodiment. One eccentric lobe is provided on the exterior surface of each tube. In this manner the tubes are rotated upon their axes. In this manner the contact force imparted by the bar assembly on the panel is maximized.

Note is taken in FIG. 5 that the exterior surface of the Tee-nuts are covered with an apertured plastic facing. Such facings for each bar assembly are preferably of a distinctive color indicative of the size of the bar assembly.

From a generic stand point, the invention includes a bar assembly. The bar assembly includes hollow interior and exterior tubes. Each tube has an inner and an outer end. The tubes are each of a length less than the distance between spaced vertical window jamb side surfaces. The bar assembly includes rigid stoppers. A stopper is press fit into the outer end of each tube. The bar assembly includes pins. A pin extends outwardly from each stopper. The bar assembly includes a coil spring. The coil spring is provided within the exterior tube. The coil spring has a first end. The first end is in contact with the stopper of the exterior tube. The coil spring has a second end. The second end is in contact with the inner end of the interior tube. The coil spring is adapted to be compressed to a loading orientation. The coil spring is further adapted to be expanded to an operational orientation.

As may be seen in FIGS. 1, 2 and 5, the invention includes aligned apertures. Sleeves are provided. The sleeves face each other. The sleeves are provided in the spaced vertical jamb side surfaces. The sleeves are adapted to receive the pins when in an operational orientation.

As may be seen in FIGS. 8 and 9, an alternate embodiment of the invention, there are included parallel lag bolts 102. The lag bolts are provided in a wall on opposite sides of the vertical jamb side surfaces. The lag bolts include aligned apertures 104. The apertures are adapted to receive the pins when in an operational orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hurricane protection system comprising:

a bar assembly including hollow interior and exterior tubes each tube having an inner and an outer end, the tubes being of a length less than the distance between spaced vertical window jamb side surfaces, a rigid stopper press fit into the outer end of each tube with a pin extending outwardly from each stopper, each pin including a base and a Tee-nut received within an axial aperture in the stopper, each base being threadedly received within a Tee-nut, aligned apertures with sleeves facing each other in the jamb side surfaces adapted to receive the pins when in an operational orientation, a coil spring within the exterior tube with a first end in contact with the stopper of the exterior tube and a second end in contact with the inner end of the interior tube, the coil spring adapted to be compressed to a loading orientation and expanded to the operational orientation.

2. The system as set forth in claim 1 and further including a pair of wedges adjacent the bar assembly to maximize the contact force imparted by the bar assembly on a panel.

3. A hurricane protection system for precluding damage to windows during hurricanes in an efficient and economical comprising, in combination:

a rectangular window oriented in an essentially vertical plane with an inside and an outside, the window being retained by a peripheral support;

a wall in an essentially vertical plane having a rectangular opening defined by a horizontal header surface above and a horizontal sill surface below and spaced vertical jamb side surfaces there between, the spaced vertical jamb side surfaces being spaced by a fixed distance, the surfaces fixedly supporting the peripheral support with the window there within, the jamb side surfaces each having pairs of cylindrical holes with the holes of each pair being in axial alignment and spaced from the header surface and the sill surface, a plastic sleeve of a length to be received within each hole;

a ridged wooden panel in a rectangular configuration positioned within the opening in contact with the peripheral support during operation and use and with an upper edge adjacent to the header surface, a lower edge adjacent to the sill surface and parallel side edges adjacent to the jamb side surfaces;

a bar assembly including a hollow interior tube having an inner end and an outer end, the bar assembly also including a hollow exterior tube having an inner end and an outer end, the tubes are each of a length less than the distance between the spaced vertical jamb side surfaces, a rigid stopper formed with an axial aperture and press fit into the outer end of each tube with a pin extending outwardly from each stopper, each pin including a base and a Tee-nut received within one of the axial apertures, each base being threadedly received within a Tee-nut, a coil spring within the exterior tube with a first end in contact with the stopper of the exterior tube and a second end in contact with the inner end of the interior tube, the coil spring adapted to be compressed to a loading orientation whereby the pins are located between the sleeves and an expanded operational orientation with the pins within the sleeves and the tubes in proximity to the panel; and a pair of wedges on the panel facing the bar assembly to maximize the contact force imparted by the bar assembly on the panel.

* * * * *